United States Patent [19]

Rothert

[11] 4,010,107

[45] Mar. 1, 1977

[54] CORROSION-INHIBITING FUNCTIONAL FLUID

[75] Inventor: Kenneth Rothert, San Francisco, Calif.

[73] Assignee: Chevron Research Company, San Francisco, Calif.

[22] Filed: Feb. 2, 1976

[21] Appl. No.: 654,667

[52] U.S. Cl. ..... 252/32.7 E; 252/42.7; 252/48.8; 252/58; 252/388

[51] Int. Cl.[2] ..... C10M 1/48

[58] Field of Search ..... 252/37.7 E, 42.7, 48.8, 252/58, 388, 33.4

[56] References Cited

UNITED STATES PATENTS

| | | | |
|---|---|---|---|
| 3,344,074 | 9/1967 | Bowers | 252/58 |
| 3,361,667 | 1/1968 | Wenborne et al. | 252/32.7 E |
| 3,898,169 | 8/1975 | Kretzinger et al. | 252/58 |
| 3,920,562 | 11/1975 | Foehr | 252/33.4 |
| 3,933,659 | 1/1976 | Lyle et al. | 252/32.7 E |

*Primary Examiner*—C. Davis
*Attorney, Agent, or Firm*—G. F. Magdeburger; C. J. Tonkin; L. L. Priest

[57] ABSTRACT

Functional fluid lubricating oil compositions are provided which comprise (A) an oil of lubricating viscosity, and (B) an effective amount of each of the following: (1) an alkenyl succinimide, (2) a Group II metal salt of a dihydrocarbyl dithiophosphoric acid, (3) a friction modifier, (4) a Group II metal salt of a hydrocarbyl sulfonic acid, and (5) a chlorinated olefin containing from about 15 to 50 carbon atoms, from 20 to 60% by weight chlorine, and having a boiling point of at least about 300° F. Such lubricating compositions are useful as functional fluids in systems requiring fluid coupling, hydraulic fluid and/or lubrication of relatively moving parts. The lubricating compositions of the invention are particularly useful as the functional fluid in automatic transmissions, particularly in passenger automobiles.

7 Claims, No Drawings

CORROSION-INHIBITING FUNCTIONAL FLUID

BACKGROUND OF THE INVENTION

1. Field of the Invention

This invention relates to lubricating oil compositions, particularly to lubricating oil compositions useful as functional fluids in systems requiring fluid coupling, hydraulic fluid, and/or lubrication of relatively moving parts. In a preferred embodiment, this invention relates to a lubricating oil composition useful as the functional fluid in automatic transmissions, particularly automatic transmissions used in passenger automobiles.

Automatic transmission fluids are required to have a variety of desirable characteristics besides acting as a satisfactory fluid coupling. Among these are allowing the transmission to shift smoothly, allowing the transmission to lock up during a shift from one speed to another within a certain specified period of time, and lubricating relatively moving parts such as bearing surfaces and clutch plates.

An automatic transmission is a complicated piece of machinery. It includes a turbine drive unit with a torque converter and one or more clutches which are engaged and disengaged automatically by an intricate hydraulic control unit. In a typical automatic transmission the clutches are made up of alternating steel plates and steel plates faced on both sides with a friction material such as compressed paper.

The functional fluid used in automatic transmissions is subjected to very severe conditions of use. The temperature of the automatic transmission fluid under normal operating conditions will reach 275° F. Under more servere conditions, such as during climbing hills, trailer towing, stop-and-go traffic in the metropolitan areas, etc., the fluid temperature can increase significantly above this, up to, for example 325° F and higher. In addition, the fluid is constantly being pumped and agitated, thereby being brought into intimate contact with the atmosphere within the automatic transmission. Fresh air and atmospheric moisture are constantly introduced through the transmission housing breather tube.

An additional problem has arisen in automatic transmissions in that, when a copper brazing alloy containing from about 7 to 8% phosphorus, about 5 to 7% silver, and less than 1% trace elements is used in the transmission fluid cooling system, severe corrosion can occur. This corrosion can cause leakage which damages the transmission and can necessitate its replacement.

It is an object of this invention to provide a functional fluid which prevents or retards corrosion of alloys which are contacted by said functional fluid. A further object of this invention is to provide a functional fluid which prevents or retards corrosion of a brazing alloy having the composition as defined above.

2. Description of the Prior Art

Closely related lubricating oil compositions which do not prevent or retard corrosion in the brazing alloy described above are described in U.S. Pat. No. 3,920,562.

SUMMARY OF THE INVENTION

It has now been found that the addition of a chlorinated olefin to a lubricating oil composition prevents or retards corrosion when this fluid contacts a copper alloy containing about 7 to 8% phosphorus, about 5–7% silver, and less than 1% trace elements.

The lubricating oil compositions of this invention comprise (a) an oil of lubricating viscosity, and (b) an effective amount of each of the following: (1) an alkenyl succinimide, (2) a Group II metal salt of a dihydrocarbyl dithiophosphoric acid, (3) a friction modifier, (4) a Group II metal salt of a hydrocarbyl sulfonic acid, and (5) a chlorinated olefin containing from about 15 to 50 carbon atoms, from 20 to 60% by weight chlorine, and having a boiling point of at least about 300° F. These lubricating oil compositions are useful as the functional fluids in systems requiring fluid coupling, hydraulic fluids and/or lubrication of relatively moving parts. These fluids are particularly valuable since their useful life is significantly greater than functional fluids currently available.

DETAILED DESCRIPTION OF THE INVENTION

As described above, the corrosion-inhibiting functional fluid compositions of this invention comprise a major amount of an oil of lubricating viscosity and an effective amount of each of an alkenyl succinimide, a Group II metal salt of a dihydrocarbyl dithiophosphoric acid, a friction-modifying composition, preferably a fatty acid ester of a polyhydric alcohol or oil-soluble oxyalkylated derivatives thereof, a fatty acid amide of low-molecular-weight amino acids, an N-fatty alkyl-N,N-diethanol amine, an N-fatty alkyl-N,N-di(ethoxyethanol)amine, an N-fatty alkyl-N,N-di(polyethoxy)ethanol amine, or mixtures thereof, a Group II metal salt of a hydrocarbyl sulfonic acid, and a chlorinated olefin containing from about 15 to 50 carbon atoms, from 20 to 60% by weight chlorine, and having a boiling point of at least about 300° F.

The alkenyl succinimide is present to, among other things, act as a dispersant and prevent formation of deposits formed during operation of the system containing the functional fluid. Alkenyl succinimides are well known. They are the reaction product of a polyolefin polymer-substituted succinic anhydride with an amine, preferably a polyalkenyl polyamine. The polyolefin polymer-substituted succinimide anhydrides are obtained by the reaction of a polyolefin polymer or a derivative thereof with maleic anhydride. The succinic anhydride thus obtained is reacted with the amine. The preparation of the alkenyl succinimides has been described many times in the art. See, for example, U.S. Pat. No. 3,390,082, in Cols. 2 through 6, wherein such a description is set forth. The alkenyl succinimides prepared by the techniques set forth therein are suitable for use in the present invention.

Particularly good results are obtained with the lubricating oil compositions of this invention when the alkenyl succinimide is derived from a polyisobutene-substituted succinic anhydride and a polyalkylene polyamine.

The polyisobutene from which the polyisobutene-substituted succinic anhydride is derived is obtained from the polymerization of isobutene and can vary widely in its compositions. The average number of carbon atoms can range from 30 or less to 250 or more, with a resulting number average molecular weight of about 400 or less to 3000 or more. Preferably, the average number of carbon atoms per polyisobutene molecule will range from about 50 to about 100 with the polyisobutenes having a number average molecular weight of about 600 to about 1500. More preferably, the average number of carbon atoms per polyisobutene molecule ranges from about 60 to about 90, and the number average molecular weight range from about 800 to about 1300. The polyisobutene is reacted with maleic anhydride according to well-known procedures to yield the polyisobutene-substituted succinic anhydride.

The substituted succinic anhydride is reacted with a polyalkylene polyamine to yield the corresponding succinimide. Each alkylene radical of the polyalkylene polyamine usually has up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case the number of amine groups exceeds the number of alkylene groups by 1. Preferably the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, di-(trimethylene)triamine, tri-(hexamethylene)tetraamine, etc.

Other amines suitable for preparing the alkenyl succinimide useful in this invention include the cyclic amines such as piperizine, morpholine and dipiperizines.

Preferably the alkenyl succinimides used in the compositions of this invention have the following formula:

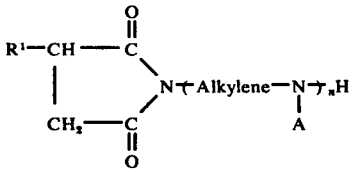

(I)

wherein:

a. $R^1$ represents an alkenyl group, preferably a substantially saturated hydrocarbon prepared by polymerization of aliphatic mono-olefins, (preferably $R^1$ is derived from isobutene and has an average number of carbon atoms and a number average molecular weight as described above).

b. the "Alkylene" radical represents a substantially hydrocarbyl group containing up to about 8 carbon atoms and preferably containing from about 2–4 carbon atoms as described hereinabove, c. A represents a hydrocarbyl group, an amine-substituted hydrocarbyl group, or hydrogen. The hydrocarbyl group and the amine-substituted hydrocarbyl groups are generally the alkyl and amino-substituted alkyl analogs of the alkylene radicals described above (preferably A represents hydrogen), and d. *n* represents an integer of from about 1 to 10, and preferably from about 3–5.

The alkenyl succinimide is present in the lubricating oil compositions of the invention in an amount effective to act as a dispersant and prevent the deposit of contaminants formed in the oil during operation of the system containing the functional fluid. This effective amount can vary widely and is relatively high compared to the levels of alkenyl succinimide normally used in lubricating oils. For example, the amount of alkenyl succinimide can range from about 1.4 percent to about 4% weight of the total lubricating oil composition. Preferably, the amount of alkenyl succinimide present in the lubricating oil composition of the invention ranges from about 1.75 to about 2.25 percent by weight of the total composition.

As set forth above, the lubricating oil compositions of the invention contain a Group II metal salt of a dihydrocarbyl dithiophosphoric acid. One function of this salt is to act as an oxidation inhibitor thereby preventing the formation of a variety of oxygenated hydrocarbon products which impair the usefulness and shorten the useful life of the lubricating oil.

As stated above, the temperatures to which the functional fluids of automatic transmissions are subjected are often severe. Under these thermally severe conditions, not only is the lubricating oil quite prone to oxidation, but antioxidant additives quite often undergo thermal degradation. Accordingly, for a functional fluid to have an extended useful life, the oxidation inhibitor added to the lubricating oil must have good thermal stability at these relatively high temperatures, or its thermal degradation products must also exhibit antioxidation properties.

It has now been found that the above-mentioned Group II metal salts of dihydrocarbyl dithiophosphoric acids exhibit the antioxidant and thermal stability properties required for the severe service proposed. Group II metal salts of phosphorodithioic acids have been described previously. See, for example, U.S. Pat. No. 3,390,080, cols. 6 and 7, wherein these compounds and their preparation are described generally. Suitably, the Group II metal salts of the dihydrocarbyl dithiophosphoric acids useful in the lubricating oil composition of this invention contain from about 4 to about 12 carbon atoms, preferably from about 6 to about 12 carbon atoms, and most preferably 8 carbon atoms, in each of the hydrocarbyl radicals. The metals suitable for forming these salts include barium, calcium, strontium, zinc and cadmium, of which zinc is preferred.

Preferably, the Group II metal salt of a dihydrocarbyl dithiophosphoric acid has the following formula:

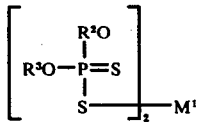

(II)

wherein:

e. $R^2$ and $R^3$ each independently represents a hydrocarbyl radical as described above, and f. $M^1$ represents a Group II metal cation as described above.

The dithiophosphoric salt is present in the lubricating oil compositions of this invention in an amount effective to inhibit the oxidation of the lubricating oil. This effective amount can vary widely and typically ranges from about 0.5 to about 1.5 percent by weight of the total composition, preferably the salt is present in an amount ranging from about 0.75 to about 1.0 percent by weight of the total lubricating oil composition.

The preferred fatty acid esters of polyhydric alcohols or oil-soluble oxyalkylated derivatives thereof, a fatty acid amide of a low-molecular-weight amino acid, an N-fatty alkyl-N,N-diethanol amine, an N-fatty alkyl-N,N-di(ethoxyethanol) amine, an N-fatty alkyl-N,N-di(polyethoxy) ethanol amine, or mixtures thereof, are contained in the lubricating oil compositions of the invention principally act as friction modifiers to give the lubricating oil the proper frictional characteristics. These frictional characteristics are particularly important where the functional fluid is to be used in automatic transmissions. The frictional properties of the oil are an important factor in how the oil-lubricated clutch plates lock up during shifting. A detailed description of the preferred friction modifiers is found in U.S. Pat. No. 3,933,662, the disclosure of which is hereby incorporated by reference.

Generally, the composition contains from 0.05 to about 0.8% weight of the friction-modifying component based on the total composition. For lubricating oil compositions intended for use in automatic transmissions used in automobiles manufactured by Ford Motor Company, these friction modifiers should be used in concentrations of from about 0.05 to about 0.3 weight percent, preferably from about 0.1 to about 0.2 weight percent of the composition. For lubricating oil compositions intended for use in automatic transmissions used in automobiles manufactured by General Motors Corporation, these friction modifiers should be used in concentrations of from about 0.1 to about 0.6 weight percent, preferably from about 0.15 to about 0.3 weight percent of the composition.

As stated above, the lubricating oil compositions of the invention contain a Group II metal salt of a hydrocarbyl sulfonic acid. One of the functions of this salt is to act as a detergent and dispersant. Among other things it prevents the deposit of contaminants formed during high temperature operation of the system containing the functional fluid.

The Group II metal salts of hydrocarbyl sulfonic acids are well known. Many of these salts have been used as additives to lubricating oil compositions. These salts comprise the neutralization product obtained by reacting a Group II metal base with the product obtained by treating a hydrocarbon oil with sulfuric acid. The resulting oil-derived sulfonic acid, when neutralized with the Group II metal compound, yields the sulfonate which forms part of the composition of this invention.

Several processes for preparing these sulfonates are briefly outined in U.S. Pat. No. 2,395,713. Other processes are also discussed in U.S. Pat. No. 2,388,677.

The hydrocarbon portion of the sulfonate used in the lubricating oil compositions of the invention is derived from a hydrocarbon oil stock or synthetic organic moieties such as alkylated aromatics. Being derived from such a material the hydrocarbon moiety is a mixture of different hydrocarbyl groups, the specific composition of which depends upon the particular oil stock which was used as the starting material. The fraction of the oil stock which becomes sulfonated is predominantly an aliphatic-substituted carbocyclic ring. The sulfonic acid group attaches to the carbocyclic ring. The carbocyclic ring is predominantly aromatic in nature, although a certain amount of the cycloaliphatic content of the oil stock will also be sulfonated. The aliphatic substituent of the carbocyclic ring affects the oil solubility and detergency properties of the sulfonate. Suitably, the aliphatic substituent contains from about 12 to about 30 carbon atoms, and preferably from about 20 to 25 carbon atoms. The aliphatic substituent can be a straight or branched chain and can contain a limited number of olefinic linkages, preferably less than 5 percent of the total carbon-to-carbon bonds are unsaturated.

The Group II metal cation of the sulfonate suitably is magnesium, calcium, strontium, barium, or zinc, and preferably is magnesium, calcium, or barium. Most preferably the Group II metal is calcium.

Preferably, the Group II metal salt of the hydrocarbylsulfonic acid has the following formula:

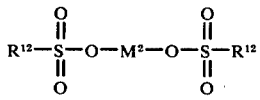

(VII)

wherein:

n. each $R^{12}$ represents a hydrocarbyl group as described above, and o. $M^2$ represents a Group II metal cation as described above.

The Group II metal salts of hydrocarbyl sulfonic acids are present in the lubricating oil compositions of the invention in an amount effective to prevent the deposit of contaminants formed in the oil during severe high temperature operation of the system containing the composition. This effective amount can vary widely and typically ranges from about 0.9 percent to about 1.8% weight, preferably from about 1.0 to about 1.4% weight of the total lubricating oil composition.

The corrosion-inhibiting or retarding properties are imparted to the lubricating oil composition of this invention by the combination of a chlorinated olefin with the components that have been previously described. To be effective in this composition, the chlorinated olefin should contain from about 15 to 50 carbon atoms and from 20 to 60% by weight chlorine. In order to prevent excessive loss of the chlorinated olefin from the lubricating oil composition during use, the chlorinated olefin should have a boiling point of at least about 300° F. The chlorinated olefin may be, for example, a cracked wax olefin obtained using conventional cracking methods to crack the wax followed by chlorination. Alternatively, the chlorinated olefin may be derived by isomerizing an alpha-olefin followed by chlorination. Particularly preferred are chlorinated olefins containing from about 20 to about 38 carbon atoms and from about 30% to 50% by weight chlorine. It is understood that the chlorinated olefins need not be pure mixtures of a single-molecular-weight chlorinated olefin. More preferably, the chlorinated olefin is a mixture of various olefins having a carbon content within the range described and varying amounts of chlorination per molecule. The ranges given represent average values for the total composition of the chlorinated olefin.

Generally, adequate corrosion control is obtained when from 0.01 to 1 weight percent of the chlorinated olefin is present in the lubricating oil composition. Preferably, from about 0.05 to 0.5 percent of the chlorinated olefin is used in the compositions of this invention.

Automatic Transmission Fluids

In a preferred embodiment the compositions of this invention are particularly suited for use in automatic transmissions, particularly in passenger automobiles. Automatic transmission fluids generally have a viscosity in the range from about 75 to 1000 SUS (Saybolt Universal Seconds) at 100° F and from about 35 to 75 SUS at 210° F. The base oils for the automatic transmission fluids are light lubricating oils and ordinarily have a viscosity in the range of about 50 to 400 SUS at 100° F and 33 to 50 SUS at 210° F. The base stock is a lubricating oil fraction of petroleum, either naphthenic or paraffinic base, unrefined, acid refined, hydrotreated, or solvent refined as required in the particular lubricating need. Also, synthetic oils meeting the necessary viscosity requirements, either with or without viscosity index improvers, may be used as the base stock.

To summarize, the various constitutents will be present in the automatic transmission fluid as follows. The alkenyl succinimide used in this invention generally will be present in the functional fluid in from about 1.4 to about 4 % weight, more usually from about 1.75 to about 2.25% weight. In concentrates prepared for addition to the base oil prior to use, the alkenyl succinimide can be present in from about 10 to about 35 weight percent. The Group II metal salt of a dihydrocarbyl dithiophosphoric acid will generally be present in the functional fluid in from about 0.5 to about 1.5% weight, more usually from about 0.75 to about 1.0% weight. The dithiophosphoric acid salts may be present in concentrates in from about 5 to about 20% weight. The friction-modifying component, e.g., the fatty acid esters and oil-soluble oxyalkylated derivatives thereof a fatty acid amide of low-molecular-weight amino acids, an N-fatty alkyl-N,N-diethanol amine, an N-fatty alkyl-N,N-di(ethoxyethanol)amine, an N-fatty alkyl-N,N-di(polyethoxy)ethanol amines, or mixtures thereof, will generally be present in the functional fluid in from about 0.1 to about 0.8% weight, more usually from about 0.2 to about 016% weight. The amine may be present in concentrates in from about 2 to about 6% weight. The Group II metal salt of a hydrocarbyl sulfonic acid will generally be present in the functional fluid in from about 0.9 to about 1.8% weight, more usually from about 1.0 to about 1.4% weight. The sulfonic acid salt may be present in concentrates in from about 5 to about 15% weight. The chlorinated olefin will generally be present in the functional fluid in from about 0.01 to 12% weight, more usually from 0.05 to 0.5% weight. The chlorinated olefin may be present in concentrates in from 0.15 to 25%, preferably 0.75 to 7.5% weight.

The functional fluid will normally contain other additives. It is usually necessary to heavily compound such oils in order to meet the exacting requirements specified.

Included among the other additives which can be used are additional oxidation inhibitors, such as, for example, the adduct obtained by combining terpene and phosphorous pentasulfide. Suitable materials are commercially available under the trade names Santolube and Hitec available from Monsanto Company and Edwin L. Cooper, Ltd. respectively.

Also commonly used in functional fluids are antifoam agents such as various fluorosilicone compounds commercially available. A particularly good antifoam agent is available from Dow Corning under the name FS 1265 Fluid.

Also included in functional fluids are viscosity improving agents which are normally high-molecular-weight polymers such as the acrylate polymers. Useful examples include the copolymers of alkyl methacrylate with vinyl pyrrolidine available under the trade name "Acryloid" from Rohm & Haas and terpolymers derived from stryene, alkylacrylates and nitrogen-containing polymer precursors available from Lubrizol Corporation under the name Lubrizol 3700 Series and methacrylates available from Texaco, Inc. Other viscosity improving agents include hydrocarbon polymers such as polyisobutylene or ethylene/propylene copolymers.

These additives will be present in the functional fluid in varying amounts necessary to accomplish the purpose for which they were included. For example, additional oxidation inhibitors such as the terpene-phosphorous pentasulfide adduct may be present in amounts ranging from about 0.1 percent to about 1% weight or more. The fluorosilicone antifoam agent, for example, will generally be present in from about 2 to about 50 ppm. The viscosity index improver will normally be present in from about 0.5 to about 15 percent by weight of the base oil, more usually from about 2 to about 10 percent by weight of the base oil.

Other additives include pour point depressants, antisquawk agents, seal swell agents, etc. Numerous automatic transmission fluid additives are listed in U.S. Pat. Nos. 3,156,652 and 3,175,976, which disclosure is incorporated herein by reference.

These various additives are also often incorporated into the concentrates and will be present therein in correspondingly higher concentrations.

What is claimed is:

1. A lubricating oil composition comprising:

a. an oil of lubricating viscosity, and b. an effective amount of each of the following:

1. an alkenyl succinimide,
2. a Group II metal salt of a dihydrocarbyl dithiophosphoric acid,
3. a friction modifier,
4. a Group II metal salt of a hydrocarbyl sulfonic acid, and
5. a chlorinated olefin.

2. The composition of claim 1 wherein 1. said alkenyl succinimide is a polyisobutenyl succinimide of a polyalkylene polyamine,
2. said hydrocarbyl groups of said dithiophosphoric acid contain from 4 to 12 carbon atoms,
3. the friction modifier is selected from a fatty acid ester of a polyhydric alcohol or oil-soluble oxyalkylated derivatives thereof, a fatty acid amide of a low-molecular-weight amino acid, an N-fatty alkyl-N,N-diethanol amine, an N-fatty alkyl-N,N-di(ethoxyethanol) amine, an N-fatty alkyl-N,N-di(-polyethoxy) ethanol amine, or mixtures thereof, said fatty alkyl group of said tertiary amine contains from 12–18 carbon atoms.
4. said Group II metal of said Group II metal salt of a hydrocarbylsulfonic acid is magnesium, calcium, or barium, and 5. said chlorinated olefin contains from 15 to 50 carbon atoms, from 20% to 60% by weight chlorine and has a boiling point of at least 300° F.

3. A lubricating oil composition of claim 1 wherein:

1. said alkenyl succinimide has the following formula:

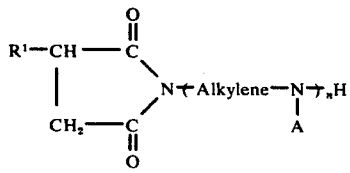

(I)

wherein:

a. $R^1$ represents an alkyl group, b. the "Alkylene" radical contains from 1 to 8 carbon atoms, c. A represents a hydrocarbyl group, an amine substituted hydrocarbyl group, or hydrogen, and d. *n* represents an integer of from 1 to 10;

2. said dithiophosphoric acid salt has the following formula:

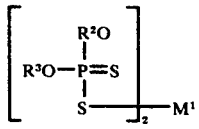

(II)

wherein:

e. $R^2$ and $R^3$ each independently represent hydrocarbon radicals, and f. $M^1$ represents a Group II metal cation; and 4. said Group II metal salt of a hydrocarbylsulfonic acid has the following formula:

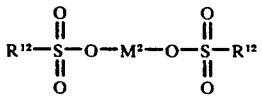

(VII)

wherein:

n. each $R^{12}$ represents a hydrocarbyl group, o. $M^2$ represents a Group II metal cation, and 300°said chlorinated olefin contains from about 15 to 50 carbon atoms, from 20 to 60% by weight chlorine and has a boiling point of at least 200° F.

4. A lubricating oil composition of claim 3 wherein:

1. in said alkenyl succinimide, a. $R^1$ represents an alkenyl group derived from polyisobutene, b. said "Alkylene" radical contains from 2 to 4 carbon atoms, c. A represents hydrogen, and d. *n* represents 3, 4 or 5;

2. in said dithiophosphoric acid salt, e. $R^2$ and $R^3$ each independently represent a hydrocarbyl radical containing from 4 to 12 carbon atoms, and f. $M^1$ represents zinc;

4. in said Group II metal salt of a hydrocarbyl sulfonic acid, $M^2$ is magnesium, calcium or barium, and 5. said chlorinated olefin is a chlorinated cracked wax olefin or a chlorinated isomerized alpha-olefin containing from 30 to 50 weight percent chlorine.

5. A lubricating oil composition of claim 4 wherein:

1. in said alkenyl succinimide, a. $R^1$ represents a polyisobutenyl radical having a number average molecular weight of from about 800 to about 1300, b. said "Alkylene" radical contains 2 carbon atoms, and c. *n* represents 4;

2. in said dithiophosphoric acid salt, d. $R^2$ and $R^3$ each independently represent a hydrocarbyl radical containing from 4 to 8 carbon atoms, and 5. said chlorinated olefin is a chlorinated cracked wax olefin of 20 to 48 carbon atoms.

6. A lubricating oil composition of claim 5 wherein said composition contains 1. from 1.4 to 4% weight of said alkenyl succinimide,
2. from 0.5 to 1.5% weight of said dithiophosphoric acid salt,
3. from 0.1 to 0.8% weight of said friction modifier,
4. from 0.9 to 1.8% weight of said Group II metal salt of a hydrocarbylsulfonic acid, and
5. from 0.01 to 1% weight of said chlorinated olefin.

7. A lubricating oil composition of claim 6 wherein said composition contains 1. from 1.75 to 2.25% weight of said alkenyl succinimide,
2. 0.75 to 1.0% weight of said dithiophosphoric acid salt,
3. from 0.2 to 0.6% weight of said friction modifier,
4. from 1.0 to 1.4% weight of said Group II metal salt of a hydrocarbylsulfonic acid, and
5. from 0.05 to 0.3% weight of said chlorinated olefin.

* * * * *